US008950297B2

(12) United States Patent
Sumg

(10) Patent No.: US 8,950,297 B2
(45) Date of Patent: Feb. 10, 2015

(54) SOCKET WITH A REINFORCED STRENGTH

(71) Applicant: Li-Yuan Sumg, Taichung (TW)

(72) Inventor: Li-Yuan Sumg, Taichung (TW)

( * ) Notice: Subject to any disclaimer, the term of this patent is extended or adjusted under 35 U.S.C. 154(b) by 211 days.

(21) Appl. No.: 13/737,072

(22) Filed: Jan. 9, 2013

(65) Prior Publication Data

US 2014/0123818 A1 May 8, 2014

(30) Foreign Application Priority Data

Nov. 5, 2012 (TW) ..... 101141026 A

(51) Int. Cl.

| | |
|---|---|
| ***B25B 13/06*** | (2006.01) |
| *B25B 23/12* | (2006.01) |
| *B25B 13/48* | (2006.01) |
| *B25B 13/50* | (2006.01) |
| *B25B 13/02* | (2006.01) |
| *B25B 23/00* | (2006.01) |

(52) U.S. Cl.

CPC ..... *B25B 13/06* (2013.01); *B25B 13/065* (2013.01); *B25B 23/12* (2013.01); *B25B 13/48* (2013.01); *B25B 13/5091* (2013.01); *B25B 13/02* (2013.01); *B25B 23/00* (2013.01)

USPC ..... 81/121.1; 81/124.6; 81/125

(58) Field of Classification Search

CPC ..... B25B 13/06; B25B 13/065; B25B 13/48; B25B 13/5091; B25B 13/02; B25B 23/12; B25B 23/00

USPC ..... 81/121.1, 120, 125, 124.2, 124.6, 81/124.3, 124.7

See application file for complete search history.

(56) References Cited

U.S. PATENT DOCUMENTS

| | | | | |
|---|---|---|---|---|
| 5,782,148 | A * | 7/1998 | Kerkhoven | 81/124.6 |
| 5,945,901 | A * | 8/1999 | Coleman et al. | 335/285 |
| 6,003,411 | A * | 12/1999 | Knox et al. | 81/53.2 |
| 7,270,034 | B2 * | 9/2007 | Hu | 81/124.3 |
| 7,311,022 | B2 * | 12/2007 | Putney et al. | 81/125 |
| 7,841,261 | B2 * | 11/2010 | Milligan et al. | 81/121.1 |
| 8,516,930 | B2 * | 8/2013 | Tsai | 81/124.6 |
| 2009/0064825 | A1 * | 3/2009 | Milligan et al. | 81/121.1 |
| 2014/0053692 | A1 * | 2/2014 | Hu | 81/121.1 |

* cited by examiner

*Primary Examiner* — Monica Carter
*Assistant Examiner* — Melanie Alexander
(74) *Attorney, Agent, or Firm* — Alan D. Kamrath; Kamrath IP Lawfirm, P.A.

(57) ABSTRACT

A socket includes a body and a reinforcing sleeve. The body includes first and second coupling ends for respectively coupling with a fastener and a driving tool. The first coupling end includes a conical section having a small diameter end and a large diameter end. A spacing between the small diameter end and the second coupling end along the longitudinal axis is smaller than a spacing between the large diameter end and the second coupling end along the longitudinal axis. The conical section has increasing diameters perpendicular to the longitudinal axis away from the second coupling end. The reinforcing sleeve is mounted around the conical section of the body to reinforce the socket.

13 Claims, 5 Drawing Sheets

SOCKET WITH A REINFORCED STRENGTH

BACKGROUND OF THE INVENTION

The present invention relates to a socket with a reinforced strength and, more particularly, to a socket including a body and a reinforcing sleeve having a hardness greater than that of the body to increase the strength of the socket.

U.S. Pat. No. 5,782,148 discloses a socket including an end having a driving opening for coupling with a wrench or the like. The other end of the socket includes a dual-depth fastener receiving recess for receiving a fastener. Such a socket can be used in many situations, such as connecting with a pneumatic or electric wrench or used in automatic machines, such as numerical controlled machines, for tightening or loosening fasteners of a workpiece. However, the fastener receiving recess of the socket is liable to crack in corners thereof due to repeated impact and collision with fasteners. The tightening torque of the socket is insufficient if the socket has cracks. In addition, the socket with cracks may injure workers or even causes damage to the workpiece or the machine. Frequent replacement of the socket is inevitable, resulting in an increase in the costs.

Thus, a need exists for a reinforced socket to reduce the costs while increasing the strength.

BRIEF SUMMARY OF THE INVENTION

The present invention solves this need and other problems in the field of durable sockets by providing a socket including a body and a reinforcing sleeve. The body is made of metal and includes a first coupling end and a second coupling end opposite to the first coupling end. The first coupling end includes an actuating hole extending along a longitudinal axis of the body and having non-circular cross sections. The actuating hole is adapted to couple with a fastener. The second coupling end includes a driving hole extending along the longitudinal axis of the body and having non-circular cross sections. The driving hole is adapted to couple with a driving tool. The first coupling end includes a conical section having a small diameter end and a large diameter end. A spacing between the small diameter end and the second coupling end along the longitudinal axis is smaller than a spacing between the large diameter end and the second coupling end along the longitudinal axis. The conical section has increasing diameters perpendicular to the longitudinal axis away from the second coupling end. The diameter of the large diameter end perpendicular to the longitudinal axis is larger than the diameter of the small diameter end perpendicular to the longitudinal axis. The reinforcing sleeve is made of metal and mounted around the conical section of the body to increase a strength of the socket.

Preferably, the reinforcing sleeve includes first and second end faces and an inner periphery extending between the first and second end faces of the sleeve. The inner periphery of the sleeve includes an engagement portion engaged with the conical section of the body. The reinforcing sleeve has a hardness greater than a hardness of the body.

Preferably, the engagement portion of the sleeve has an initial inner diameter before the sleeve is mounted on the body. The initial inner diameter is slightly smaller than the diameter of the of the large diameter end of the conical section perpendicular to the longitudinal axis of the body. An engagement area of the engagement portion of the sleeve engaged with the conical section of the body forms a deformation section having a start adjacent to the small diameter end and an end adjacent to the large diameter end. The deformation section has increasing deformations from the start towards the end. The deformation section has a maximum deformation at the large diameter end.

Preferably, the first coupling end has an end face, and the first coupling end of the body further includes a shoulder. The conical section is located between the end face and the shoulder. The large diameter end of the conical section is connected to the end face of the first coupling end. The small diameter end of the conical section is connected to the shoulder.

Preferably, the shoulder includes an outer peripheral edge contiguous to an outer periphery of the body and an inner peripheral edge contiguous to the small diameter end of the conical section.

Preferably, the diameter of the large diameter end of the conical section is smaller than a diameter of the outer peripheral edge of the shoulder perpendicular to the longitudinal axis of the body.

Preferably, the engagement portion of the reinforcing sleeve has a constant inner diameter from the first end face through the second end face.

Preferably, the first end face of the reinforcing sleeve abuts the shoulder.

Preferably, the second end face of the reinforcing sleeve is flush with the end face of the first coupling end of the body.

Preferably, the body further includes a guiding face extending between the large diameter end of the conical section and the end face of the first coupling end of the body. The guiding face has decreasing diameters perpendicular to the longitudinal axis towards the end face of the first coupling end of the body.

Preferably, the conical section has a conicity smaller than a conicity of the guiding face. The guiding face includes an inner peripheral edge contiguous to an outer peripheral edge of the end face of the first coupling end of the body. The inner peripheral edge of the guiding face has a diameter perpendicular to the longitudinal axis smaller than the inner diameter of the engagement portion of the reinforcing sleeve.

Preferably, the diameter of the inner peripheral edge of the guiding face is smaller than the diameter of the small diameter end of the conical section.

Preferably, the first end face of the reinforcing sleeve includes an inner peripheral edge. The reinforcing sleeve further includes a sliding face between the inner peripheral edge of the first end face and the engagement portion. An intersection between the inner peripheral edge of the first end face and the sliding face has a diameter larger than the diameter of the large diameter end of the conical section of the body.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
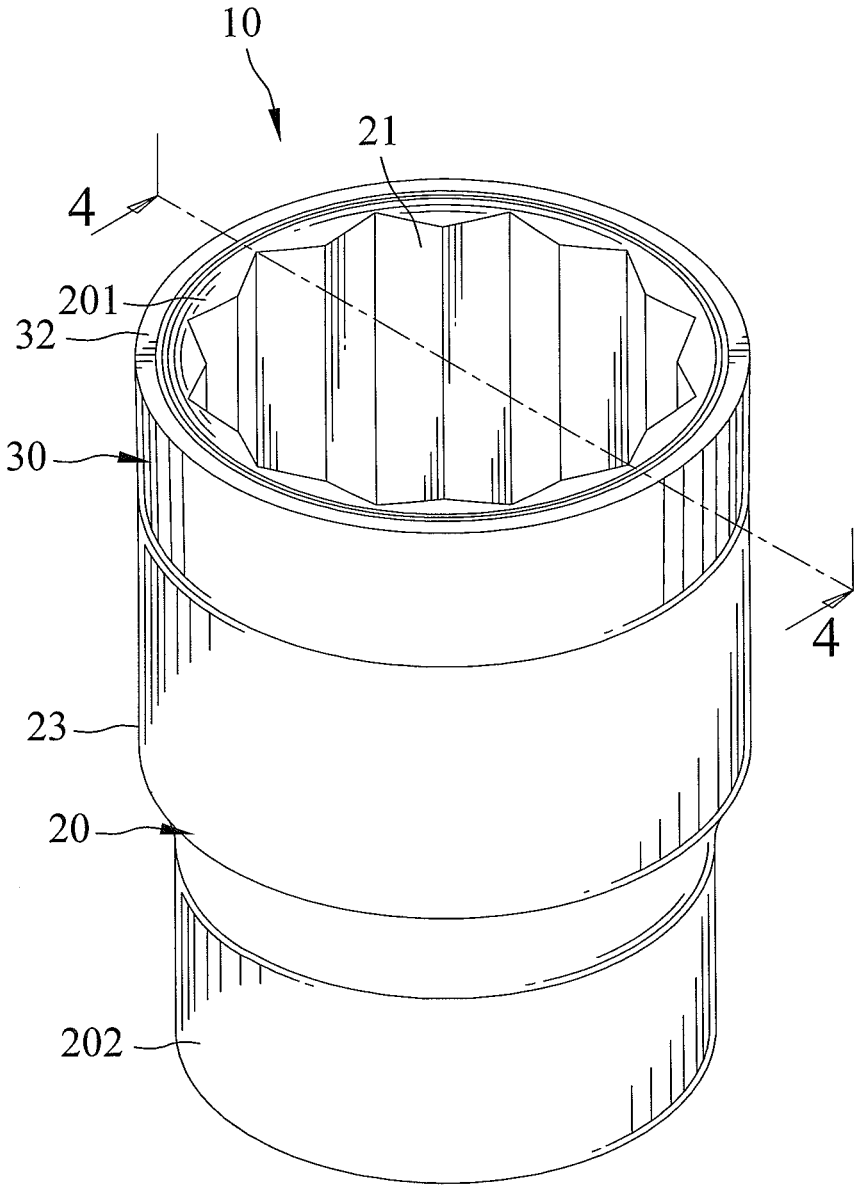
FIG. 1 shows a perspective view of a socket with a reinforced strength according to the present invention.

All figures are drawn for ease of explanation of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "edge", "end", "portion", "section", "longitudinal", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 2:
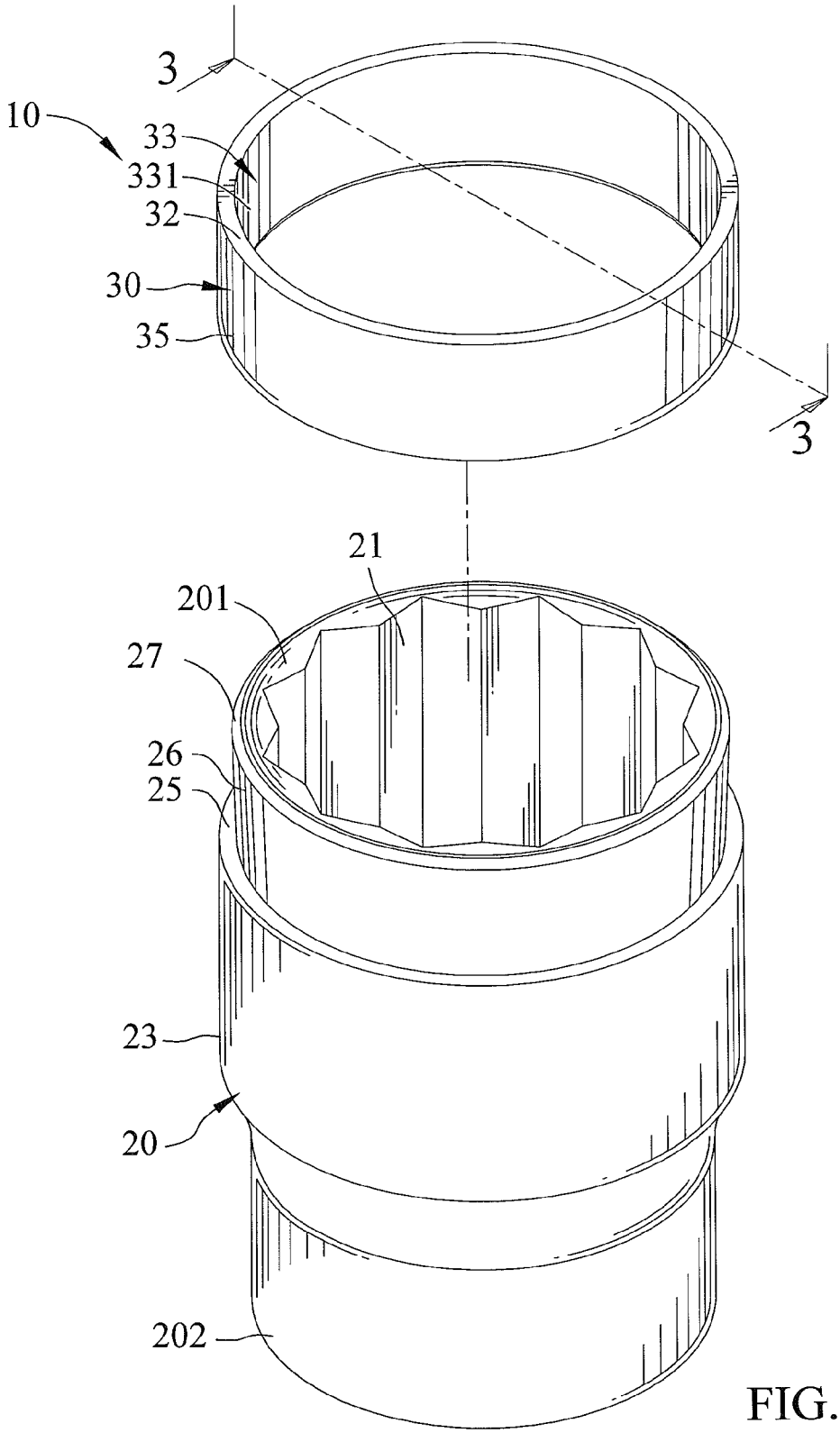
FIG. 2 shows an exploded, perspective view of the socket of FIG. 1.
Figure 3:
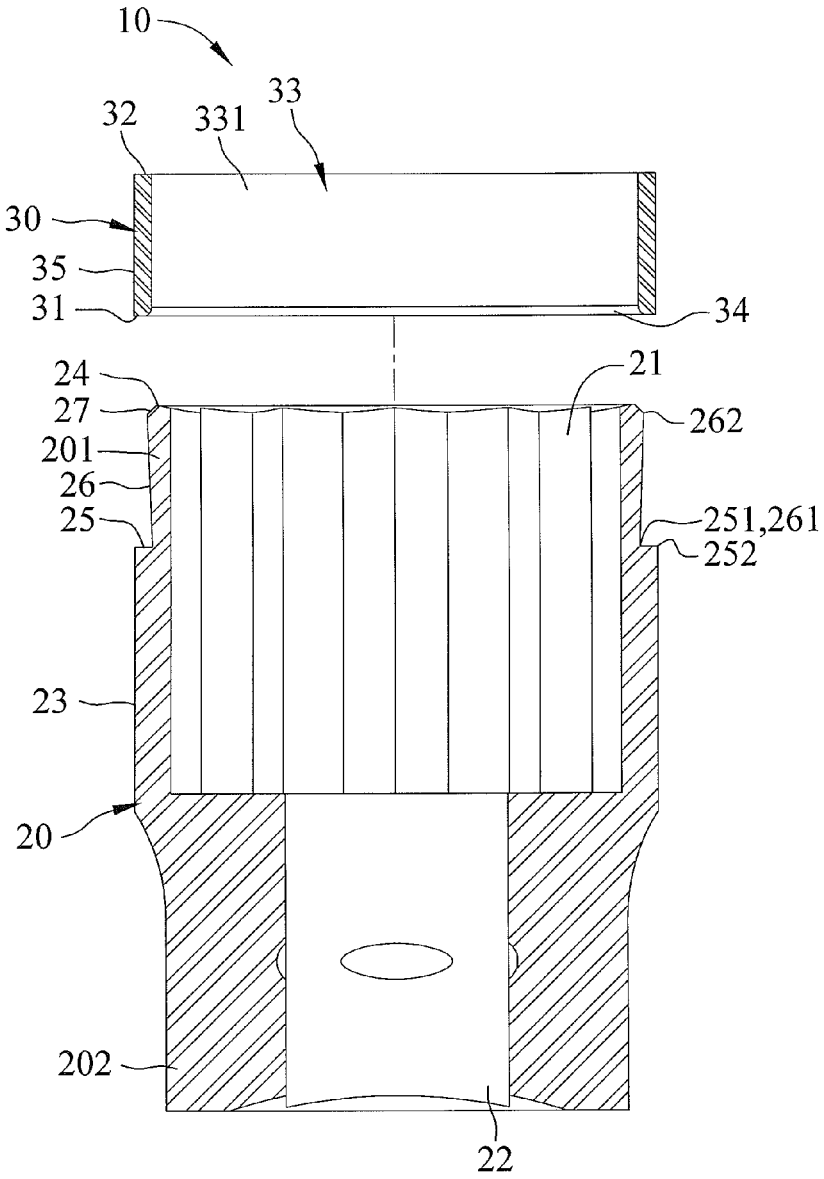
FIG. 3 shows an exploded, cross sectional view taken along section line 3-3 of FIG. 2.
Figure 4:
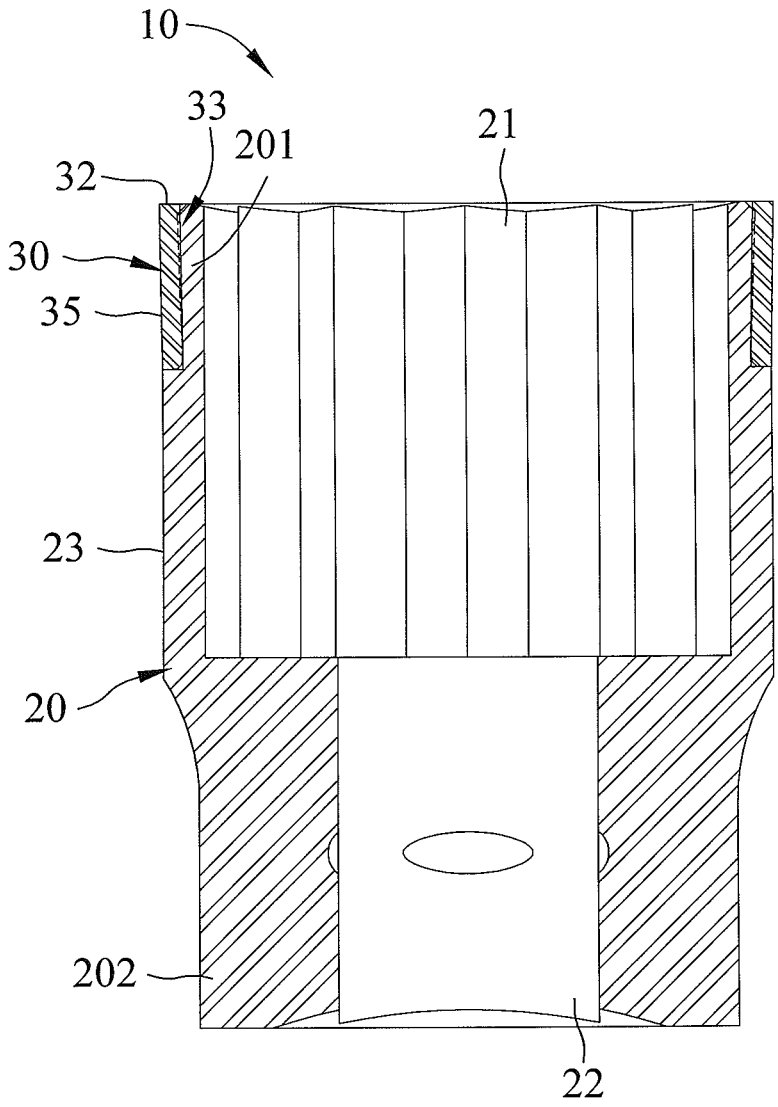
FIG. 4 shows a cross sectional view taken along section line 4-4 of FIG. 1.
Figure 5:
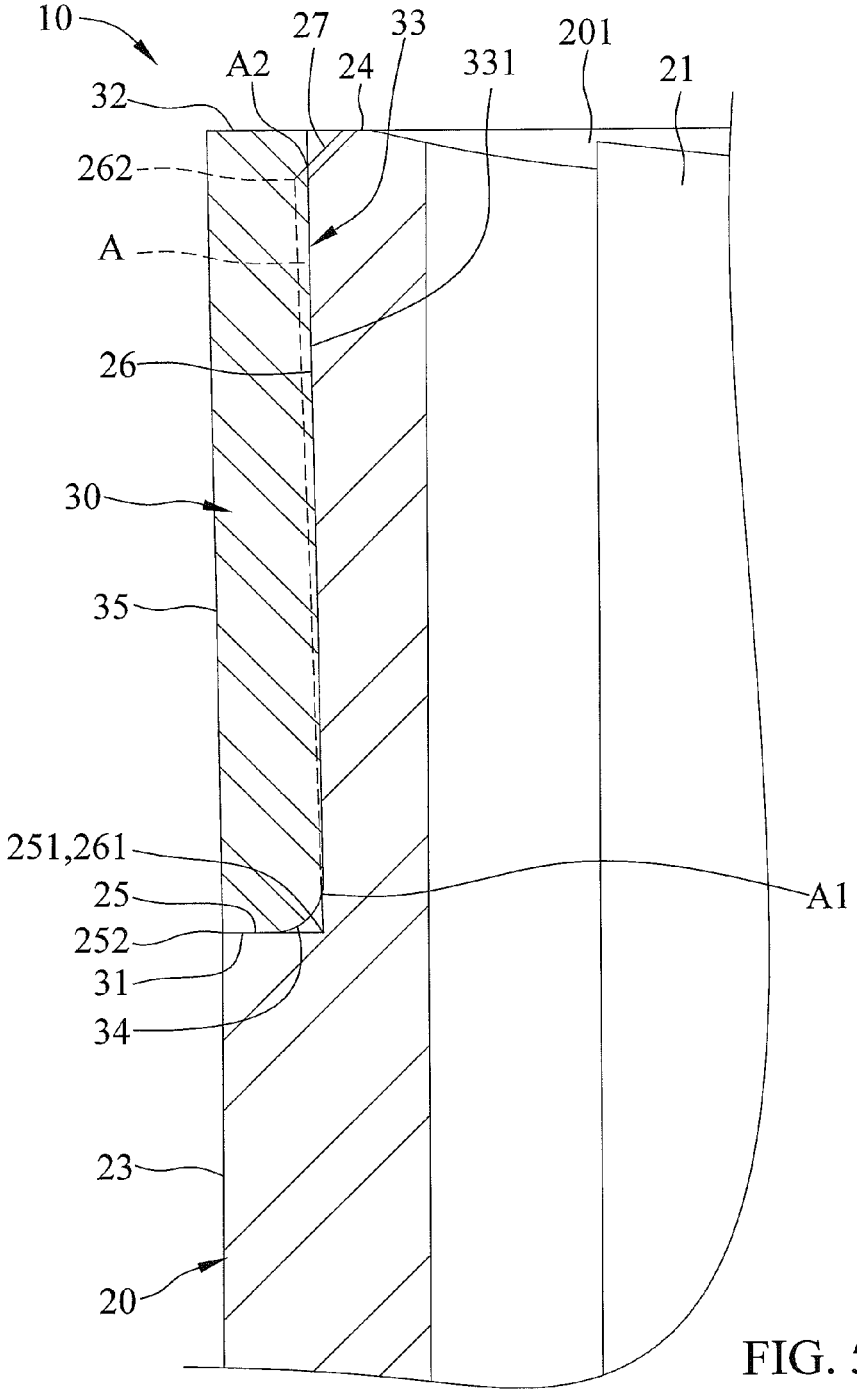
FIG. 5 shows an enlarged view of a portion of the socket of FIG. 4.

With reference to FIGS. 1-5, a socket 10 with a reinforced strength according to the present invention includes a body 20 and a reinforcing sleeve 30. The body 20 is made of metal and includes a first coupling end 201 and a second coupling end 202 opposite to the first coupling end 201. The first and second coupling ends 201 and 202 can couple with a driving tool or a fastener. The driving tool can be a hand tool, a pneumatic tool, or an electric tool. The fastener can be a hexagonal bolt or nut.

The first coupling end 201 includes an actuating hole 21 extending along a longitudinal axis of the body 20 and having non-circular cross sections. The actuating hole 21 is adapted to couple with a hexagonal fastener. The second coupling end 202 includes a driving hole 22 extending along the longitudinal axis of the body 20 and having non-circular cross sections. The driving hole 22 is adapted to couple with a driving tool having a square head.

The first coupling end 201 includes a conical section 26 having a small diameter end 261 and a large diameter end 262. A spacing between the small diameter end 261 and the second coupling end 202 along the longitudinal axis is smaller than a spacing between the large diameter end 262 and the second coupling end 202 along the longitudinal axis. The conical section 26 has increasing diameters perpendicular to the longitudinal axis away from the second coupling end 202. The diameter of the large diameter end 262 perpendicular to the longitudinal axis is larger than the diameter of the small diameter end 261 perpendicular to the longitudinal axis.

The body 20 includes an outer periphery 23. The first coupling end 201 of the body 20 includes an end face 24 having an inner peripheral edge at an opening of the actuating hole 21. The first coupling end 201 of the body 20 further includes a shoulder 25. The conical section 26 is located between the end face 24 and the shoulder 25. The large diameter end 262 of the conical section 26 is connected to the end face 24 of the first coupling end 201. The small diameter end 261 of the conical section 26 is connected to the shoulder 25. In the form shown, the shoulder 25 includes an outer peripheral edge 252 contiguous to the outer periphery 23 of the body 20 and an inner peripheral edge 251 contiguous to the small diameter end 261 of the conical section 26. The diameter of the large diameter end 262 of the conical section 26 is smaller than a diameter of the outer peripheral edge 252 of the shoulder 25 perpendicular to the longitudinal axis of the body 20.

The body 20 further includes a guiding face 27 extending between the large diameter end 262 of the conical section 26 and the end face 24 of the first coupling end 201 of the body 20. The guiding face 27 has decreasing diameters perpendicular to the longitudinal axis towards the end face 24 of the first coupling end 201 of the body 20. The conical section 26 has a conicity smaller than a conicity of the guiding face 27. In the form shown, the guiding face 27 includes an inner peripheral edge contiguous to an outer peripheral edge of the end face 24 of the first coupling end 201 of the body 20. A diameter of the inner peripheral edge of the guiding face 27 perpendicular to the longitudinal axis is smaller than the diameter of the small diameter end 261 of the conical section 26.

The reinforcing sleeve 30 is made of metal having has a hardness greater than a hardness of the body 20. The reinforcing sleeve 30 is mounted around the conical section 26 of the body 20 to increase the strength of the socket 10. The reinforcing sleeve 30 includes first and second end faces 31 and 32 and inner and outer peripheries 33 and 35, with each of the inner and outer periphery 33 and 35 extending between the first and second end faces 31 and 32 of the reinforcing sleeve 30.

The inner periphery 33 of the reinforcing sleeve 30 includes an engagement portion 331 engaged with the conical section 26 of the body 20. The engagement portion 331 of the reinforcing sleeve 30 has a constant inner diameter from the first end face 31 through the second end face 32. The diameter of the inner peripheral edge of the guiding face 27 is smaller than the inner diameter of the engagement portion 331 of the reinforcing sleeve 30. After assembly, the first end face 31 of the reinforcing sleeve 30 abuts the shoulder 25, and the second end face 32 of the reinforcing sleeve 30 is flush with the end face 24 of the first coupling end 201 of the body 20.

The reinforcing sleeve 30 has an initial inner diameter before the reinforcing sleeve 30 is mounted on the body 20. The initial inner diameter is slightly smaller than the diameter of the large diameter end 262 of the conical section 26 of the body 20. The engagement portion 331 of the reinforcing sleeve 30 is mounted around the conical section 26 of the body 20 by tight coupling, avoiding the reinforcing sleeve 30 from disengaging from the body 20.

After the reinforcing sleeve 30 is mounted around the body 20, an engagement area of the engagement portion 331 of the sleeve 30 engaged with the conical section 26 of the body 20 forms a deformation section A having a start A1 adjacent to the small diameter end 261 and an end A2 adjacent to the large diameter end 262. The deformation section A has increasing deformations from the start A1 towards the end A2, with the deformation section A having a maximum deformation at the large diameter end 262. Thus, the pressing force imparted to the engagement portion 331 of the reinforcing sleeve 30 increases from the first end face 31 towards the second end face 32. As a result, the reinforcing sleeve 30 can not disengage from the body 20, effectively increasing the tight coupling effect.

The reinforcing sleeve 30 further includes a sliding face 34 between an inner peripheral edge of the first end face 31 and the engagement portion 331. An intersection between the inner peripheral edge of the first end face 31 and the sliding face 34 has a diameter larger than the diameter of the large diameter end 262 of the conical section 26 of the body 20. In the form shown, the sliding face 34 is in the form of a rounded corner.

In assembly, the reinforcing sleeve 30 is moved (such as by hammering or by a machine) from the first coupling end 201 towards the second coupling end 202 of the body 20 with the first end face 31 of the reinforcing sleeve 30 facing the body 20. Since the initial inner diameter of the engagement portion 331 of the reinforcing sleeve 30 is slightly smaller than the diameter of the large diameter end 262 of the conical section 26, the conical section 26 is squeezed inward by the engagement portion 331 during assembly. After the reinforcing sleeve 30 abuts the shoulder 25, the conical section 26 returns to its initial shape by restitution of the first coupling end 21. Thus, the engagement portion 331 of the reinforcing sleeve 30 is tightly coupled around the conical section 26 of the body 20 without the risk of disengagement.

Since the diameter of the intersection between the inner peripheral edge of the first end face 31 and the sliding face 34 is larger than the diameter of the large diameter end 262 of the conical section 26 of the body 20, the engagement portion 331 of the reinforcing sleeve 30 can smoothly be mounted around the conical section 26 of the body 20 under guidance by the guiding face 27 of the body 20 and the sliding face 34 of the reinforcing sleeve 30.

Since the hardness of the reinforcing sleeve 30 is greater than that of the body 20, the structural strength of the socket 10 is increased. This reduces the deformation of the actuating hole 21 of the first coupling end 201 during operation. Even if the actuating hole 21 of the first coupling end 201 cracks in the corners due to repeated impact and collision with fasteners, the reinforcing sleeve 30 still envelopes the first coupling end 21 of the body 20 such that the actuating hole 21 can still perform the desired driving function, reducing damage and providing desired tightening torque. Thus, the socket 10 has a longer service life.

By tight coupling between the conical section 26 of the body 20 and the engagement portion 331 of the reinforcing sleeve 30 having a diameter slightly smaller than the diameter of the large diameter end 262 of the conical section 26 and by the increasing deformations from the start A1 towards the end A2 of the deformation area A (with the deformation area A having the maximum deformation at the large diameter end 262), the assembly is completed as soon as the first end face 31 of the reinforcing sleeve 30 abuts the shoulder 25. The assembling precision requirement is not high such that the assembly can be accomplished without professional workers. Furthermore, the outer periphery 35 of the reinforcing sleeve 30 is intact, keeping the color, patterns, words, matted surface effect, or mirror finished surface effect.

Furthermore, since the hardness of the reinforcing sleeve 30 is greater than that of the body 20, the body 20 can be made of a metal having a low cost. The socket 10 still has a sufficient strength after the hard reinforcing sleeve 30 is mounted around the body 20, effectively prolonging the service life.

The outer periphery 35 of the reinforcing ring 30 is flush with the outer periphery of the body 20, such that the outer periphery 35 of the reinforcing sleeve 30 does not extend beyond the outer periphery 23 of the body 20, effectively reducing the diameter of the socket 10 while reducing the weight and the size and allowing operation in a limited space.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A socket comprising:

a body made of metal, with the body including a first coupling end and a second coupling end opposite to the first coupling end, with the first coupling end including an actuating hole extending along a longitudinal axis of the body, with the actuating hole including non-circular cross sections, with the actuating hole adapted to couple with a fastener, with the second coupling end including a driving hole extending along the longitudinal axis of the body, with the driving hole having non-circular cross sections, with the driving hole adapted to couple with a driving tool, with the first coupling end including a conical section having a small diameter end and a large diameter end, with a spacing between the small diameter end and the second coupling end along the longitudinal axis smaller than a spacing between the large diameter end and the second coupling end along the longitudinal axis, with the conical section having increasing diameters perpendicular to the longitudinal axis away from the second coupling end, with the diameter of the large diameter end perpendicular to the longitudinal axis larger than the diameter of the small diameter end perpendicular to the longitudinal axis; and a reinforcing sleeve made of metal, with the sleeve mounted around the conical section of the body and increase a strength of the socket.

2. The socket as claimed in claim 1, with the reinforcing sleeve including first and second end faces and an inner periphery extending between the first and second end faces of the sleeve, with the inner periphery of the sleeve including an engagement portion engaged with the conical section of the body, with the reinforcing sleeve having a hardness greater than a hardness of the body.

3. The socket as claimed in claim 2, with the engagement portion of the sleeve having an initial inner diameter before the sleeve is mounted on the body, with the initial inner diameter slightly smaller than the diameter of the of the large diameter end of the conical section perpendicular to the longitudinal axis of the body, with an engagement area of the engagement portion of the sleeve engaged with the conical section of the body forming a deformation section having a start adjacent to the small diameter end and an end adjacent to the large diameter end, with the deformation section having increasing deformations from the start towards the end, with the deformation section having a maximum deformation at the large diameter end.

4. The socket as claimed in claim 2, with the first coupling end having an end face, with the first coupling end of the body further including a shoulder, with the conical section located between the end face and the shoulder, with the large diameter end of the conical section connected to the end face of the first coupling end, with the small diameter end of the conical section connected to the shoulder.

5. The socket as claimed in claim 4, with the shoulder including an outer peripheral edge contiguous to an outer periphery of the body and an inner peripheral edge contiguous to the small diameter end of the conical section.

6. The socket as claimed in claim 5, with the diameter of the large diameter end of the conical section smaller than a diameter of the outer peripheral edge of the shoulder perpendicular to the longitudinal axis of the body.

7. The socket as claimed in claim 6, with the engagement portion of the reinforcing sleeve having a constant inner diameter from the first end face through the second end face.

8. The socket as claimed in claim 7, with the first end face of the reinforcing sleeve abutting the shoulder.

9. The socket as claimed in claim 8, with the second end face of the reinforcing sleeve flush with the end face of the first coupling end of the body.

10. The socket as claimed in claim 8, with the body further including a guiding face extending between the large diameter end of the conical section and the end face of the first coupling end of the body, with the guiding face having decreasing diameters perpendicular to the longitudinal axis towards the end face of the first coupling end of the body.

11. The socket as claimed in claim 10, with the conical section having a conicity smaller than a conicity of the guiding face, with the guiding face including an inner peripheral edge contiguous to an outer peripheral edge of the end face of the first coupling end of the body, with the inner peripheral edge of the guiding face having a diameter perpendicular to the longitudinal axis smaller than the inner diameter of the engagement portion of the reinforcing sleeve.

12. The socket as claimed in claim 11, with the diameter of the inner peripheral edge of the guiding face smaller than the diameter of the small diameter end of the conical section.

13. The socket as claimed in claim 10, with the first end face of the reinforcing sleeve including an inner peripheral edge, with the reinforcing sleeve further including a sliding face between the inner peripheral edge of the first end face and the engagement portion, with an intersection between the inner peripheral edge of the first end face and the sliding face having a diameter larger than the diameter of the large diameter end of the conical section of the body.

* * * * *